US008250880B2

(12) United States Patent
Moon

(10) Patent No.: US 8,250,880 B2
(45) Date of Patent: Aug. 28, 2012

(54) DISPENSER AND REFRIGERATOR HAVING THE SAME

(75) Inventor: Gi-Yong Moon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 444 days.

(21) Appl. No.: 12/251,232

(22) Filed: Oct. 14, 2008

(65) Prior Publication Data

US 2009/0095010 A1 Apr. 16, 2009

(30) Foreign Application Priority Data

Oct. 15, 2007 (KR) ..... 10-2007-0103710

(51) Int. Cl.
*F25D 3/00* (2006.01)

(52) U.S. Cl. ..... 62/389; 62/391; 62/448; 62/449; 222/108; 222/146.6

(58) Field of Classification Search ..... 62/389, 62/391, 448–449; 222/108, 146.6
See application file for complete search history.

(56) References Cited

U.S. PATENT DOCUMENTS

2005/0198991 A1* 9/2005 Harder et al. ..... 62/389
2005/0268638 A1* 12/2005 Voglewede et al. ..... 62/389
* cited by examiner

*Primary Examiner* — Cheryl J Tyler
*Assistant Examiner* — Jonathan Koagel
(74) *Attorney, Agent, or Firm* — Birch, Stewart, Kolasch & Birch, LLP

(57) ABSTRACT

A dispenser has a dispenser cover having an accommodating space with an open front surface, a tray slidably retracted in the dispenser cover, and a protrusion elastically contacted with one of the dispenser cover and the tray to thusly be relatively moved. Accordingly, the sliding of the tray can smoothly be performed, and an unexpected tray separation due to a small external force applied thereto upon opening/closing the refrigerator door can be prevented.

9 Claims, 7 Drawing Sheets

DISPENSER AND REFRIGERATOR HAVING THE SAME

RELATED APPLICATION

The present disclosure relates to subject matter contained in priority Korean Application No. 10-2007-0103710, filed on Oct. 15, 2007, which is herein expressly incorporated by reference in its entirety.

BACKGROUND OF THE INVENTION

1. Field of the Invention

The present invention relates to a dispenser and a refrigerator having the same, and particularly, to a dispenser capable of avoiding an unexpected tray separation by preventing the tray clearance, and a refrigerator having the same.

2. Background of the Invention

In general, a refrigerator includes a main body having a cooling chamber for storing foods at a low temperature, a door for opening/closing the cooling chamber, and a refrigerating cycle for supplying cold air to the cooling chamber.

In recent times, by using such characteristic of the refrigerator, a dispenser for supplying cold water and/or ice is installed. Such dispenser is typically disposed at a front surface of a refrigerator door for the convenience of use.

The dispenser includes a dispenser cover having an accommodating space with a front surface open, and a water tray or tray (hereinafter, referred to as 'tray') for temporarily storing water dropped on a bottom of the dispenser cover.

The tray may be recessed in the bottom of the dispenser cover, and configured to be extended and retracted in an up-and-down direction of the dispenser cover.

However, in the related art refrigerator, it is difficult to throw water out of the tray. In addition, the tray has a narrow width in a back-and-forth direction thereof, which makes it difficult to receive water in a container. That is, the tray has the back-and-forth width about as small as a cup being able to be put thereon. As a result, a user should grasp a container, if the container is bigger than the cup, for example, not to be fallen while catching water in the container.

SUMMARY OF THE INVENTION

Therefore, an object of the present invention is to provide a dispenser capable of allowing a smooth sliding of a tray and preventing damages of components, and a refrigerator having the same.

Another object of the present invention is to provide a dispenser capable of a tray clearance and an unexpected tray separation, and a refrigerator having the same.

Still another object of the present invention is to provide a dispenser capable of improving a user's convenience due to allowing dispensing of water or ice without having to grasp a container, and a refrigerator having the same.

To achieve these and other advantages and in accordance with the purpose of the present invention, as embodied and broadly described herein, there is provided a dispenser comprising: a dispenser cover having an accommodating space with a front surface open; a tray retracted in the accommodating space to be slidably extended back and forth; and a protrusion formed on at least one of a bottom of the dispenser cover and a lower surface of the tray to thusly contact with another one, and thereby slidably moved relative to each other.

Here, the protrusion may be elastically transformed so as to be moved up and down.

The protrusion may be protruded from a lower portion of the dispenser cover.

A stopping jaw may be downwardly protruded from a front end of the tray so as to contact with the protrusion.

The stopping jaw may be disposed such that a lower end thereof is located at a lower side as compared to an upper end of the tray.

The protrusion may be spaced apart from an inner end of the bottom of the dispenser cover by a distance set based upon an extending direction of the tray.

A slit may be penetrated adjacent to the protrusion, such that the protrusion is able to be elastically transformed.

The protrusion may be provided with guiding inclination surfaces inclined in the moving direction of the tray.

The stopping jaw may be provided with an inclined portion inclined in the moving direction of the tray.

The dispenser may further comprise a guiding unit formed in the moving direction of the tray.

The guiding unit may comprise guide ribs formed at one of the dispenser cover and the tray in the moving direction of the tray, and guides formed at another one and relatively slidable with being contacted with the guide ribs.

The guiding unit may be configured to restrict an upward movement of the tray.

In another aspect of the present invention, a dispenser may comprise: a dispenser cover having an accommodating space with a front surface open; a tray retracted in the accommodating space; a guiding unit configured to guide the tray in a back-and-forth direction and restrict an upward movement thereof, and a protrusion protruded from at least one of a bottom of the dispenser cover and a lower surface of the tray so as to elastically come in contact with another one, wherein the protrusion is disposed to be spaced apart from a rear wall of the dispenser cover by a certain distance in a back-and-forth direction.

In one aspect of the present invention, there is provided a refrigerator comprising: a refrigerator main body having a cooling chamber therein; a door configured to open/close the cooling chamber, and a dispenser formed at the door.

In another aspect of the present invention, a refrigerator may comprise: a refrigerator main body having a cooling chamber therein; a door configured to open/close the cooling chamber, and a dispenser formed at the door.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a dispenser and a refrigerator having the same in accordance with one embodiment of the present invention, with reference to the accompanying drawings.

Figure 1:
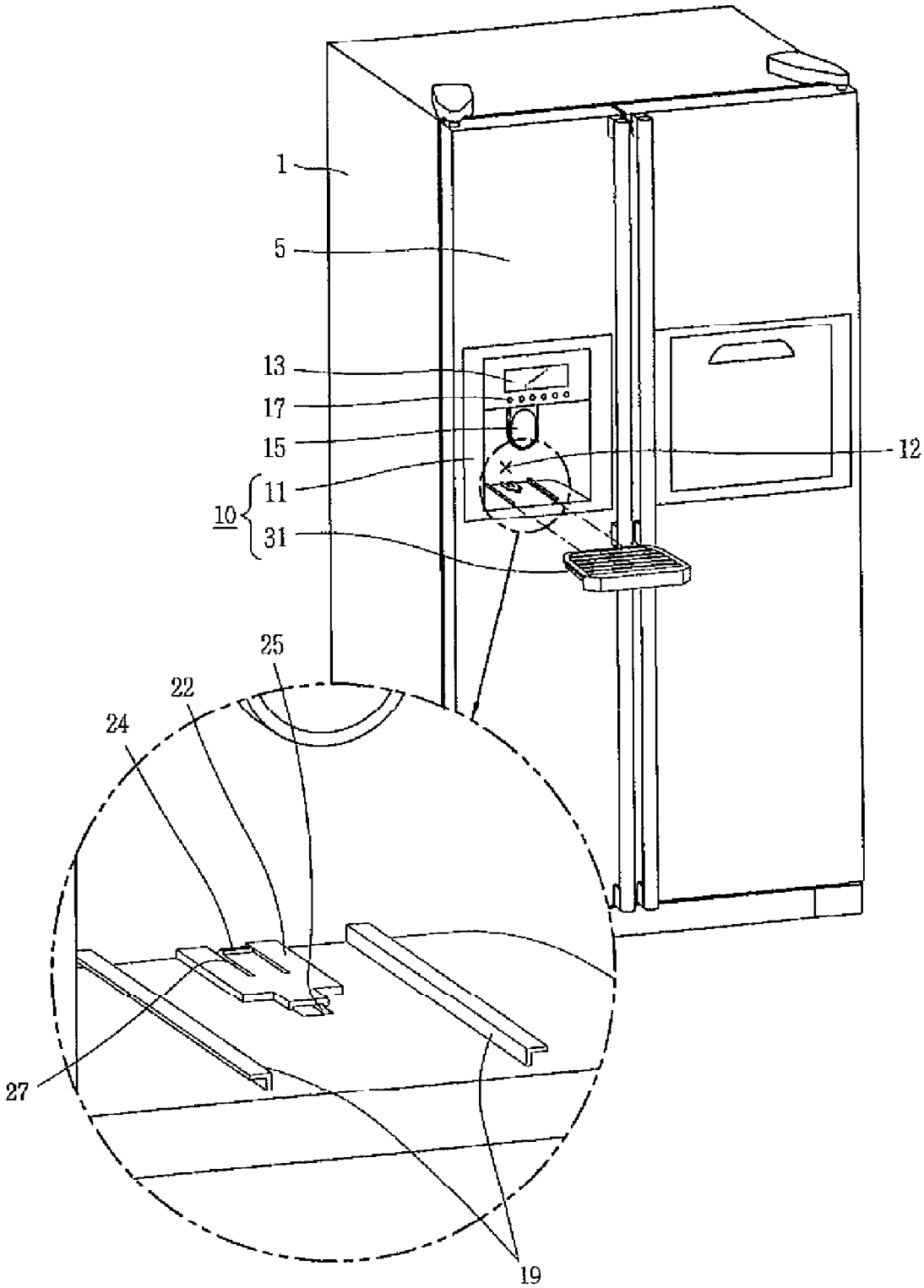
FIG. 1 is a perspective view of a refrigerator having a dispenser in accordance with one embodiment of the present invention.
Figure 2:
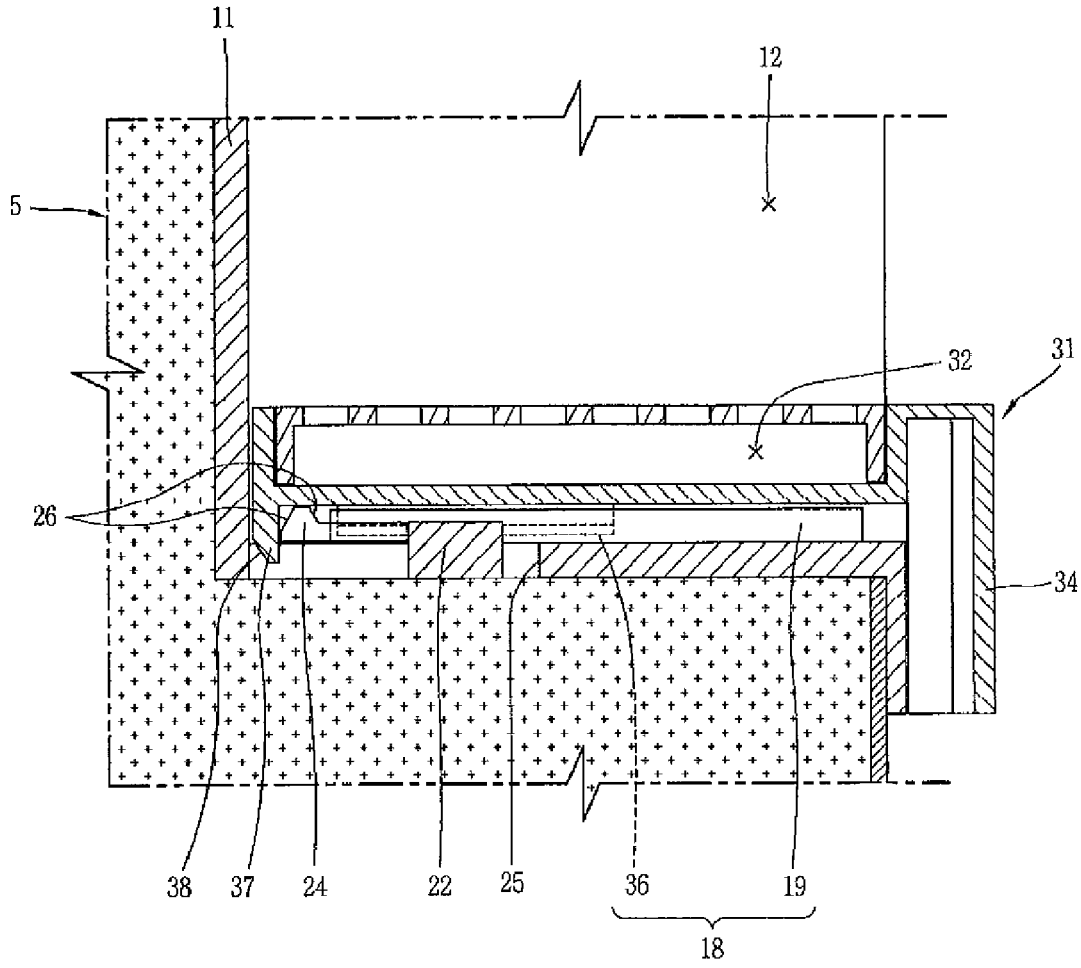
FIG. 2 is a cross-sectional view showing a coupled state of FIG. 1.

As shown in FIGS. 1 and 2, a refrigerator having a dispenser according to one embodiment the present invention may include a refrigerator main body 1 having a cooling chamber therein, a door 5 for opening/closing the cooling chamber, and a dispenser 10 installed at the door 5. Here, the cooling chamber totally indicates a refrigerating chamber and a freezing chamber, and the refrigerator main body 1 may be formed to only have the refrigerating chamber. Hereinafter, description will be made under the assumption that the refrigerator main body 1 includes both refrigerating chamber and freezing chamber and the dispenser 10 is formed at the freezing chamber door 5.

The dispenser 10 may include a dispenser cover 11 having an accommodating space 12 with a front surface open, and a tray 31 retractably received in the lower portion of the dispenser cover 11.

A display 13 for outputting certain visual information is disposed at an upper portion of the dispenser cover 11. A plurality of buttons 17 for allowing a signal input is disposed at one side of the display 13. A water outlet (not shown) through which water is dispensed is formed on a ceiling of the accommodating space 12 of the dispenser cover 11, and a lever 15 is disposed inside the accommodating space 12 so as to allow dispensing of water or ice when being rotated by being pressed.

A storage space 32 for storing water or ice dropped from the outlet (not shown) is disposed at an upper area of the tray 31. A handle 34 for facilitating an extension or retraction of the tray 31 is disposed at a front surface of the tray 31.

A guiding unit 18 for guiding the movement of the tray 31 is formed both at the tray 31 and the dispenser cover 11. The guiding unit 18 includes a pair of guide ribs 36 extending at a lower portion of the tray 31 in an extending direction, and guides 19 disposed at a bottom of the dispenser cover 11 to be slidable with being engaged with the guide ribs 36. The guides 19 and the guide ribs 36 are slidably moved back and forth, and simultaneously engaged with each other in an up-and-down direction to thusly restrict the tray 31 from being moved up and down.

A stopping jaw 37 is downwardly protruded from a front end of an insertion side at a lower portion of the tray 31. A protrusion 24 for preventing the tray 31 from being unexpectedly extended with being engaged with the stopping jaw 37 in the state of the tray 31 being retracted is formed at a lower portion of the dispenser cover 11. An inclined portion 38 is formed at one side of the stopping jaw 37 to be inclined with respect to a moving direction of the tray 31. Guiding inclination surfaces 26 are formed respectively at both sides, namely, front and rear side portions of the protrusion 24 to be inclined with respect to the moving direction of the tray 31.

A hook supporting portion 22 having an increased thickness in order to form the protrusion 24 may be formed adjacent to the protrusion 24. Slits 27 penetrated to allow the protrusion 24 to be elastically transformed in an up-and-down may also be formed adjacent to the protrusion 24. An accommodating hole 25 for accommodating a lower end portion of the stopping jaw 37 is penetrated through one side, namely, a front area of the hook supporting portion 22. Accordingly, when extending the tray 31 outwardly by a certain distance, the tray 31 can be fixed.

With such configuration, in the state of the guide ribs 36 being inserted in inlets of the guides 19, upon pressing the tray 31 backwardly, the tray 31 is slid backwardly along the guides 19 and the guide ribs 36. When the tray 31 continues to be moved backwardly, the stopping jaw 37 of the tray 31 comes in contact with the protrusion 24. The protrusion 24 is then elastically transformed by being pressed by the stopping jaw 37, thus to be moved downwardly. When the stopping jaw 37 is moved over the protrusion 24, the protrusion 24 is restored to its original position by its own elastic force. The protrusion 24 then restricts the stopping jaw 37 from being moved forwardly.

When desiring to catch water or ice in a relatively large container, upon pulling the tray 31 forwardly, the protrusion 24 is elastically transformed downwardly, and the stopping jaw 37 is moved forwardly. When the tray 31 is continuously pulled, the stopping jaw 37 is inserted in the accommodating hole 25, thereby to restrict the tray 31 from being moved back and forth.

Hereinafter, another embodiment according to the present invention will be described with reference to FIGS. 3 to 7.

Figure 3:
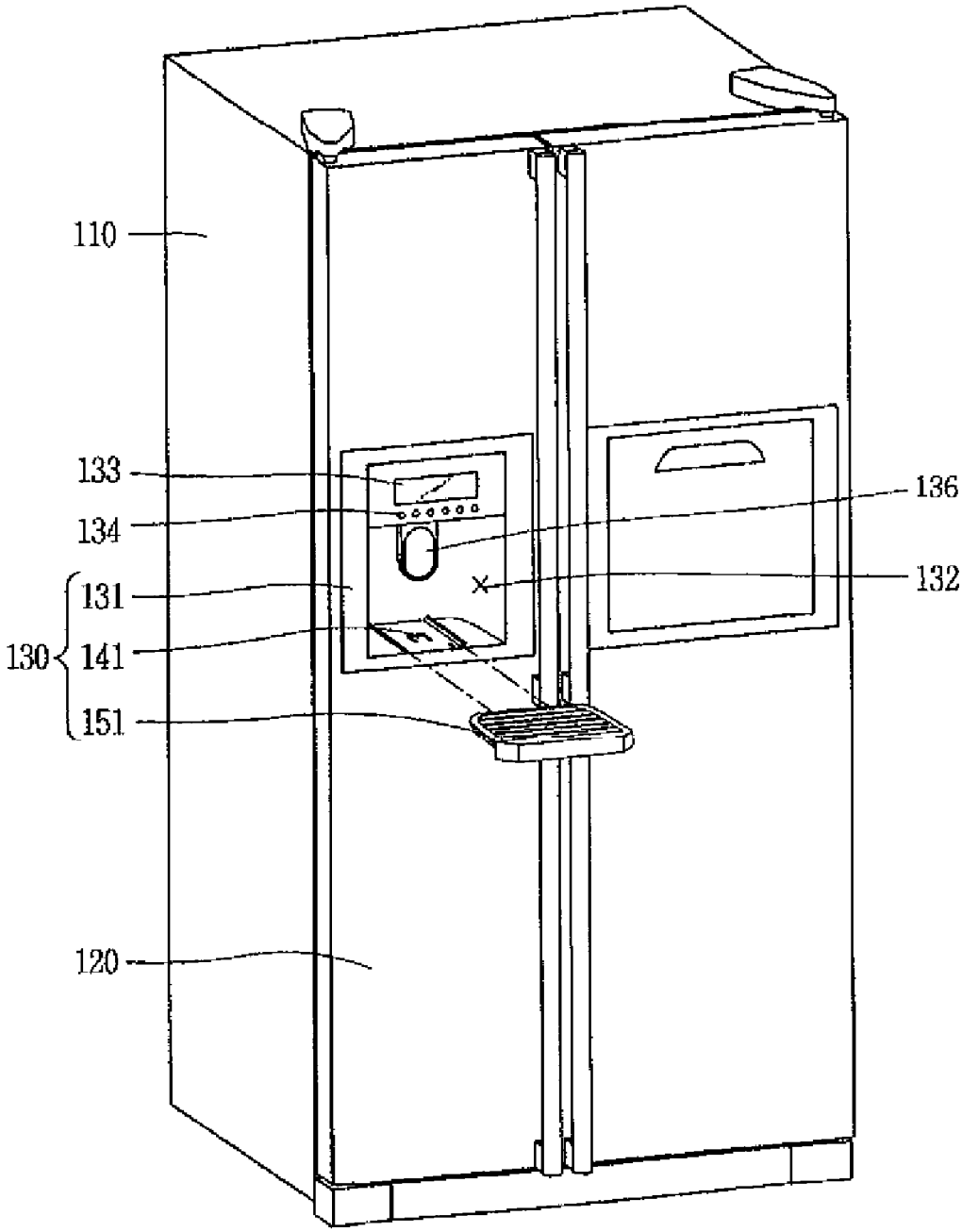
FIG. 3 is a perspective view of a refrigerator having a dispenser in accordance with another embodiment of the present invention.

As shown in FIG. 3, a refrigerator having a dispenser in accordance with another embodiment of the present invention may include a refrigerator main body 110 having a cooling chamber with a front surface open, a refrigerator door 120 coupled to the refrigerator main body 110 to open/close the cooling chamber, and a dispenser 130 installed at the refrigerator door 120 to dispense water and/or ice.

The dispenser 130 includes a dispenser cover 131 having an accommodating space 132 with a front surface open, a tray 151 slidably retracted at a lower portion of the dispenser cover 131 along a back-and-forth direction, and a protrusion 141 formed at least one of the dispenser cover 131 or the tray 151 and coming in contact with another one.

The dispenser cover 131 is inserted in the refrigerator door 120 and integrally coupled thereto such that its opening faces a front side of the refrigerator main body 110. Accordingly, water or ice can be dispensed without opening the refrigerator door 120.

A display 133 for outputting certain visual information to the exterior is disposed at an upper portion of the accommodating space of the dispenser cover 131. A plurality of buttons 134 for allowing an input of manipulation signals may be disposed at one side of the display 133. A lever 136 may be installed inside the dispenser cover 131 to be rotatable upon being contacted or by a user's manipulation force, so as to allow the dispensing of water or ice.

Figure 4:
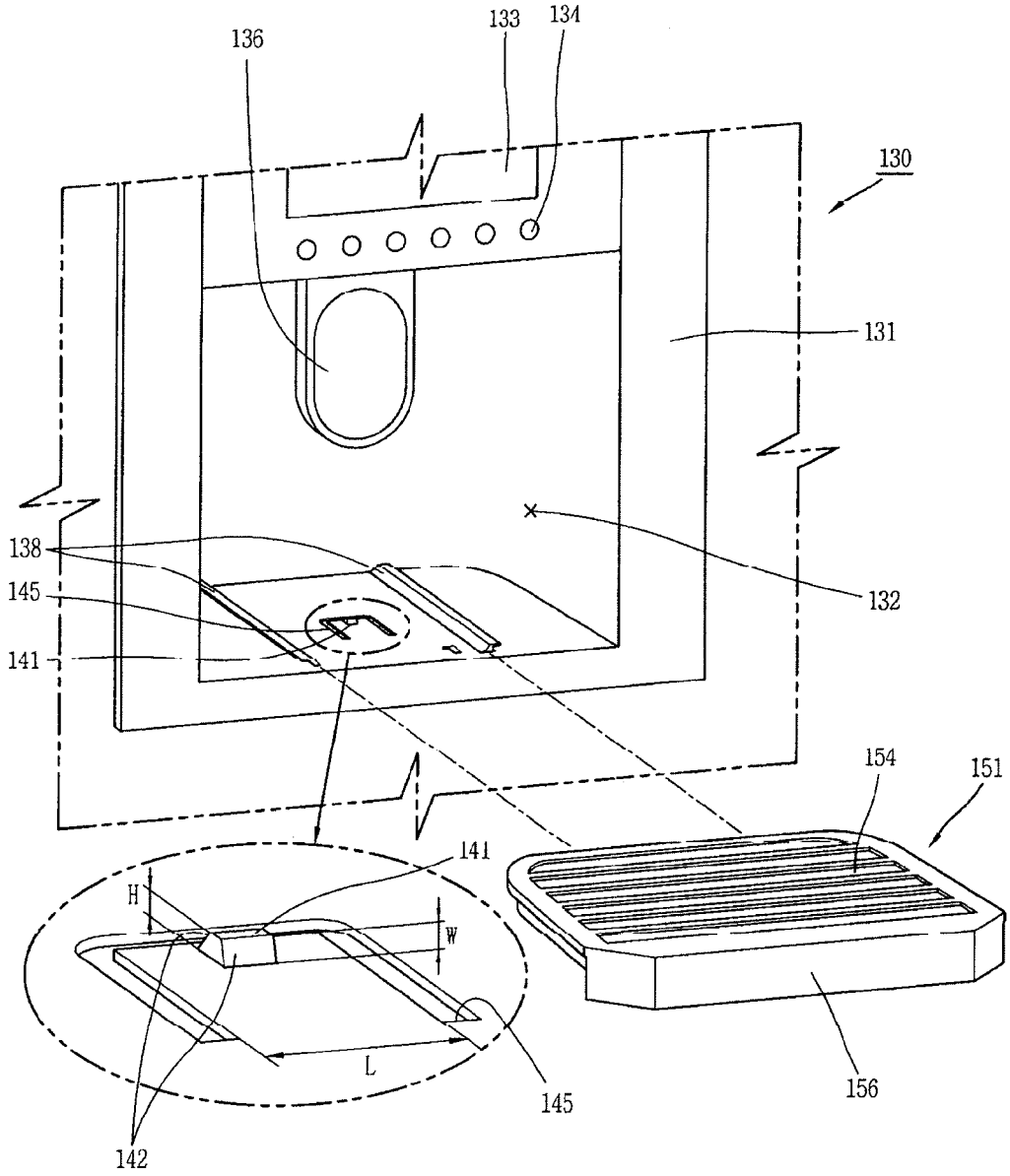
FIG. 4 is an enlarged view of main parts of FIG. 3.
Figure 5:
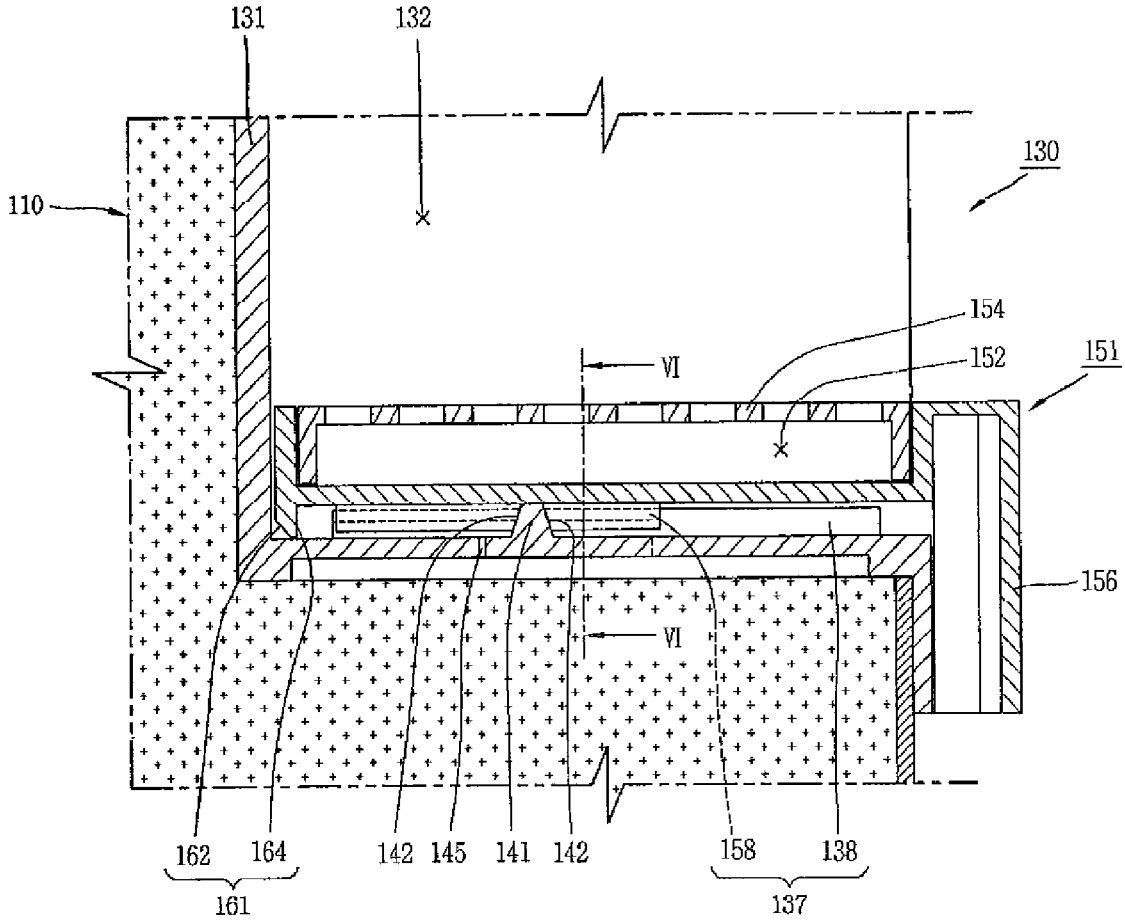
FIG. 5 is a cross-sectional view when a tray of FIG. 3 is retracted.
Figure 7:
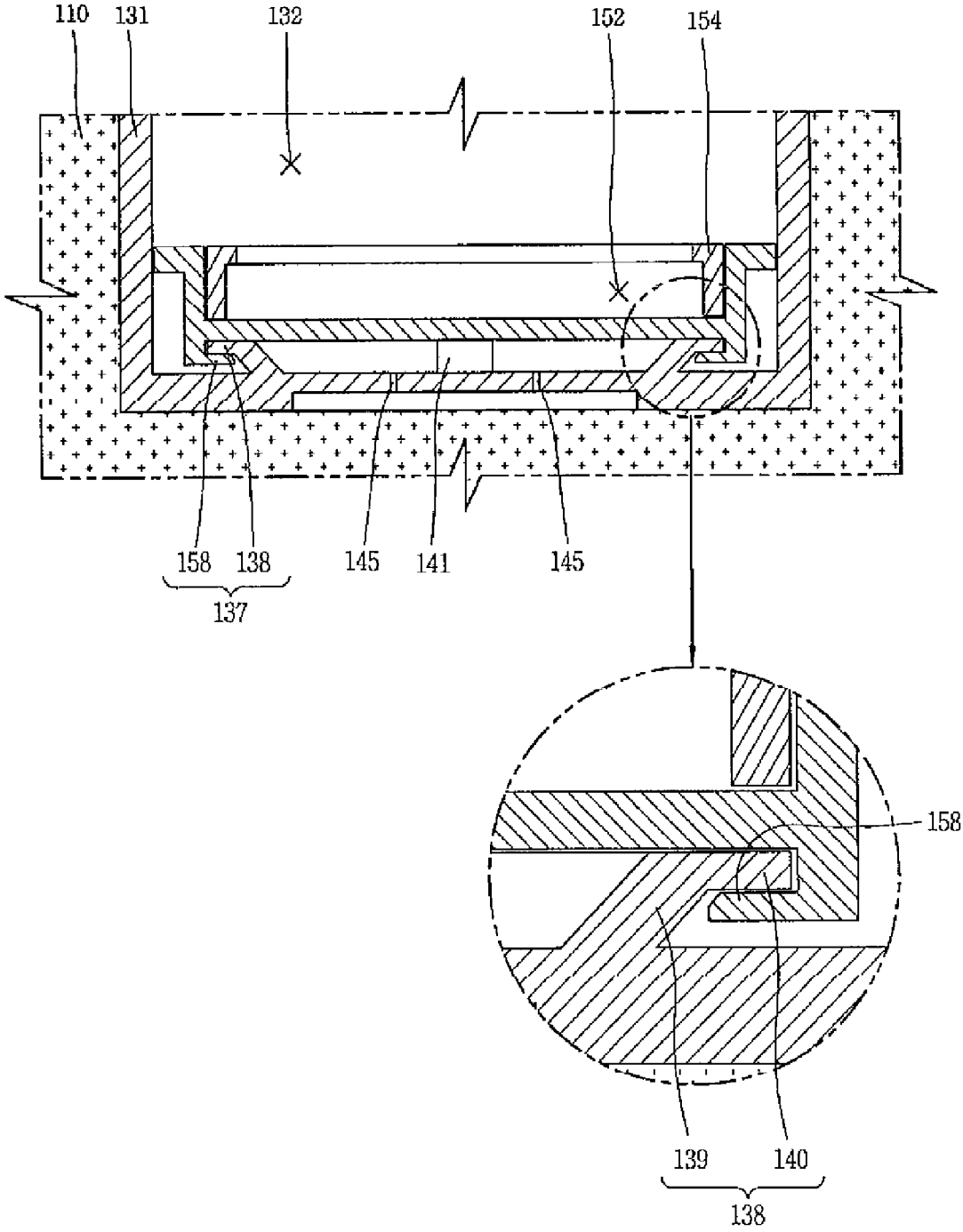
FIG. 7 is a view showing operations of protrusion and stopping jaw upon partially extending a tray of FIG. 5.

On the other hand, as shown in FIGS. 4 and 5, a guiding unit 137 for guiding the tray 151 to be slid back and forth may be formed at a bottom of the dispenser cover 131. The guiding unit 137 may include guides 138 formed at a lower portion of the dispenser cover 131 in a back-and-forth direction, and guide ribs 158 formed at the tray 151 and slidably inserted in the guides 138. The guides 138 may be implemented as a pair. Each guide 138 has a section of being protruded from the bottom of the dispenser cover 31 to be bent outwardly and extends along a back-and-forth direction. Here, as shown in FIG. 7, each guide 138 may include an inclinedly protruded portion 139 protruded from the lower portion of the dispenser cover 131 to be inclined outwardly, and a horizontally extending portion 140 extending from the inclinedly protruded portion 139 to be parallel (i.e., horizontally) with the lower portion of the dispenser cover 131.

The protrusion 141 may be configured to be upwardly protruded from the bottom of the dispenser cover 131 so as to elastically come in contact with the lower portion of the tray 151. The protrusion 141 may be formed to be spaced apart by a certain distance from an inner end of the bottom of the dispenser cover 131 in an extending direction of the tray 151. The protrusion 141 may also be formed to be disposed at the central area with respect to a right-and-left direction of the bottom of the dispenser cover 131. Here, the protrusion 141 is preferably formed near the center along the back-and-forth direction of the dispenser cover 131.

Preferably, the protrusion 141 has a longitudinally protruded height H greater than a back-and-forth width W, and has a right-and-left length L great than the longitudinally protruded height H. A slit 145 penetrated in a "U" shape, upon being shown from an upper side, is formed surrounding the protrusion 141. Accordingly, the protrusion 141 may be much smoothly elastically transformed in an up and down direction. The slit 145 may also be formed to be spaced far apart in a right-and-left direction of the protrusion 141 as compared to the back-and-forth direction thereof, which allows an increase in a connected portion between the protrusion 141 and the dispenser cover 131, thereby preventing the damage of to the protrusion 141. The protrusion 141 may include guiding inclination surfaces 142 each formed to be inclined in a retracted or extended direction of the tray 151, by which the elastic transformation of the protrusion 141 can be implemented gradually and stably.

The tray 151 is formed similar to a shape of a thin rectangular parallelepiped, and has an accommodating space 152 for accommodating water or ices at its upper area. The accommodating space 152 may be configured to be provided with a supporting board 154 for supporting a container, such as a cup, such that the container does not contact with water. A handle 156 for facilitating extension or retraction of the tray 151 may be provided at the front surface of the tray 151. This embodiment is implemented that the handle 156 extends downwardly.

Figure 6:
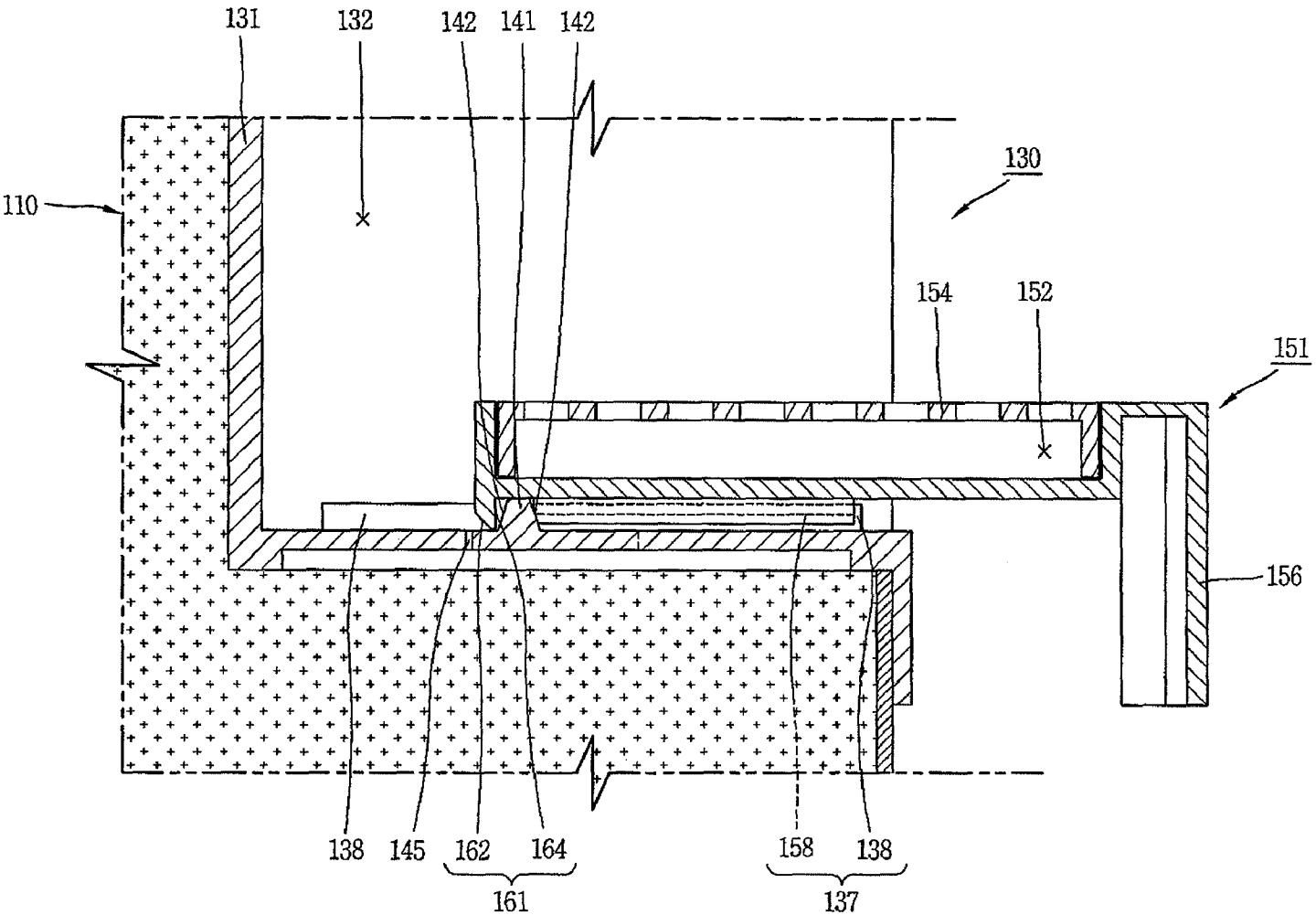
FIG. 6 is a cross-sectional view taken along the line VI-VI of FIG. 5.

As shown in FIG. 6, a pair or guide ribs 158 slidably inserted in the respective guides 138 are formed at the lower portion of the tray 151. The guide ribs 158, as shown in FIG. 7, are protruded downwardly from both sides of the tray 151 to be horizontally extended in an inward direction, thereby being inserted between the guides 138 and the bottom of the dispenser cover 131. The tray 151 is upwardly pressed by an elastic force of the protrusion 141, such that upper surfaces of the guide ribs 158 come in contact with the lower surfaces of the guides 138, resulting in restricting the upward movement of the tray 151. Also, outer ends of the guides 138 contact with inner surfaces of the guide ribs 158, so as to restrict the right-and-left movement of the tray 151.

A stopping jaw 161 may be downwardly protruded from a lower portion of a front end at an insertion portion of the tray 151. Here, the stopping jaw 161 is downwardly extended such that its lower end is disposed lower than an upper end of the protrusion 141. Accordingly, when extending the tray 151 outwardly by a certain distance for use, the stopping jaw 161 comes in contact with the protrusion 141, so as to restrict the tray 151 from being further extended from the dispenser cover 131.

An inclined portion 162 may be formed at the stopping jaw 161 so as to smoothly contact with the protrusion 141 when the tray 151 is retracted. Also, a longitudinal wall portion 164 downwardly extending from the lower portion of the tray 151 in a longitudinal direction may be formed at a side facing the inclined portion 162 of the stopping jaw 161.

With such configuration, when desiring to retract the tray 151 into the dispenser cover 131, front ends of the guide ribs 158 are respectively inserted in the guides 138, thus to press the tray 151 inwardly. The tray 151 is then slid inwardly along the guides 138. At this moment, the guiding insertion surface 142 of the protrusion 141 is surface-contacted by the inclined portion 162 of the stopping jaw 161. Under this state, when the stopping jaw 161 moves further, the protrusion 141 is pressed downwardly, so as to be elastically transformed.

After the stopping jaw 161 passes over the protrusion 141 in cooperation with the movement of the tray 151, the upper end of the protrusion 141 elastically contacts with the lower surface of the tray 151. Upper surfaces of the guide ribs 158 respectively come in contact with inner lower surfaces of the guides 138 by the elastic force of the protrusion 141, thereby increasing a frictional force. Accordingly, the tray 151 can be prevented from being unexpectedly separated due to an external force applied when opening the refrigerator door 120. In addition, the clearance of the tray 151 can be prevented and the sliding movement thereof can be smoothly performed.

In the meantime, when desiring to extend the tray 151 outwardly by a certain distance, the handle 156 of the tray 151 is grasped to pull the tray 151 such that the stopping jaw 161 comes in contact with the protrusion 141. Here, since the guide ribs 158 and the guides 138 are mutually contacted by the elastic force of the protrusion 141 and also the upper end of the protrusion 141 contacts with the lower portion of the tray 1511 the clearance of the tray 151 can be prevented and the sliding movement thereof can also be smoothly performed. In order for the stopping jaw 161 to pass over the protrusion 141 upon the extension of the tray 141, a greater force than that required to retract the tray 151 is needed, and thusly the tray 151 can be prevented from being easily separated.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

As described so far, in the present invention, a protrusion is formed such that a dispenser cover and a tray elastically contact with each other, which always provides a certain contact force between the tray and the dispenser cover. Accordingly, the clearance of the tray due to a relatively weak external force caused by opening or closing a refrigerator door can be prevented, an unexpected separation of the tray from the dispenser cover can be avoided, and also the sliding movement of the tray can be smoothly performed.

Also, in the present invention, since a protrusion is protruded from an inner side of the dispenser cover to be spaced apart by a certain distance along a moving direction of the tray, upon extending the tray, the separation of the tray from the dispenser cover can be prevented.

Furthermore, in the present invention, by forming a protrusion at a central area in back-and-forth and right-and-left directions of the dispenser cover, which is relatively easy to be elastically transformed, and allowing the protrusion to come in contact with a central area of right and left directions of the tray, which is relatively easy to be elastically transformed, the damage of the tray due to an excessive contact between the tray and the dispenser cover can be avoided and the sliding of the tray can be smoothly performed, thus to improve user's convenience.

In addition, in the present invention, the tray is allowed to be extended by a certain distance and then fixed there, whereby a user does not have to grasp a relatively large container when catching water or ice using such container.

What is claimed is:

1. A refrigerator comprising:

a refrigerator main body having a cooling chamber therein;

a door configured to open or close the cooling chamber;

a dispenser cover having an accommodating space with an open front surface;

a tray retracted in the accommodating space to be slidably extended back and forth;

a handle formed at a front of the tray, the handle extending past a front surface of the door when the tray is within the accommodating space;

a guiding unit formed in a moving direction of the tray; and a protrusion formed on a bottom of the dispenser cover to contact the lower surface of the tray, wherein the protrusion elastically deforms so as to be moved up and down, wherein the guiding unit is configured to restrict upward and lateral movements of the tray, wherein the guiding unit comprises:

guide ribs formed at one of the dispenser cover and the tray in the moving direction of the tray; and guides formed at another one of the dispenser cover and the tray and slidable relative to and contacting the guide ribs, wherein a stopping jaw is downwardly protruded from a lower portion of a back end of the tray so as to contact with the protrusion, and the stopping jaw is downwardly extended such that a lower end is lower than an upper end of the protrusion, and wherein the stopping jaw comes in contact with the protrusion after the tray is extended outwardly by a certain distance for use, so as to restrict the tray from being further extended from the dispenser cover.

2. The refrigerator of claim 1, wherein the stopping jaw is disposed such that a lower end thereof is located at a lower side of the tray as compared to an upper end of the tray.

3. The refrigerator of claim 1, wherein the protrusion is spaced apart from an inner end of the bottom of the dispenser cover by a distance set based upon an extending direction of the tray.

4. The refrigerator of claim 1, wherein the protrusion is provided with guiding inclination surfaces inclined in the moving direction of the tray.

5. The refrigerator of claim 1, wherein a stopping jaw is provided with an inclined portion inclined in the moving direction of the tray.

6. The refrigerator of claim 1, further comprising:

a slit formed penetratingly to the bottom of the dispenser cover, the slit having a "U" shape with a central portion joined to two end portions, wherein the protrusion is formed between the two end portions of the slit.

7. The refrigerator of claim 1, wherein the tray comprises:

a bottom wall;

a sidewall extending upwardly from the bottom wall to form a chamber; and a top wall spaced from the bottom wall, the top wall having apertures.

8. A refrigerator comprising:

a refrigerator main body having a cooling chamber therein;

a door configured to open or close the cooling chamber;

a dispenser portion formed with a predetermined depth in the door of a refrigerator;

a tray slidably received on the bottom of the dispenser portion;

guides formed on the bottom surface of the dispenser portion in order to withdraw the tray; and a protrusion formed on a bottom of the dispenser portion to contact the lower surface of the tray, wherein the tray comprises:

a handle protruding outwardly from the front of the tray, in order to withdraw the tray at the front side of the door, the handle protruding outwardly past a front surface of the door;

a storage space disposed at an upper area of the tray;

a tray cover forming a horizontal plane and covering the storage space; and guide ribs formed at a lower side of the tray, wherein a stopping jaw is downwardly protruded from a lower portion of a back end of the tray so as to contact with the protrusion, and the stopping jaw is downwardly extended such that a lower end is lower than an upper end of the protrusion, and wherein the stopping jaw comes in contact with the protrusion after the tray is extended outwardly by a certain distance for use, so as to restrict the tray from being further extended from the dispenser cover.

9. The refrigerator of claim 8, further comprising:

a slit formed penetratingly to the bottom of the dispenser portion, the slit having a "U" shape with a central portion joined to two end portions, wherein the protrusion is formed between the two end portions of the slit.

* * * * *